US009115935B2

(12) United States Patent
Yang

(10) Patent No.: US 9,115,935 B2
(45) Date of Patent: Aug. 25, 2015

(54) SINGLE FLOW CIRCUIT HEAT ABSORBING/RELEASE DEVICE FOR PERIODIC POSITIVE AND REVERSE DIRECTIONAL PUMPING

(76) Inventor: Tai-Her Yang, Dzan-Hwa (TW)

( * ) Notice: Subject to any disclaimer, the term of this patent is extended or adjusted under 35 U.S.C. 154(b) by 1453 days.

(21) Appl. No.: 12/292,308

(22) Filed: Nov. 17, 2008

(65) Prior Publication Data

US 2010/0122802 A1 May 20, 2010

(51) Int. Cl.

| | |
|---|---|
| ***F28F 27/00*** | (2006.01) |
| ***G05D 23/00*** | (2006.01) |
| ***F24J 3/08*** | (2006.01) |
| ***F28D 15/00*** | (2006.01) |
| ***F04C 19/00*** | (2006.01) |
| ***F28D 21/00*** | (2006.01) |
| ***F28F 13/06*** | (2006.01) |
| ***F28F 27/02*** | (2006.01) |

(52) U.S. Cl.

CPC ..... *F28D 21/00* (2013.01); *F28F 13/06* (2013.01); *F28F 27/02* (2013.01)

(58) Field of Classification Search

CPC ..... F28F 13/06; F28F 27/02; F28D 21/00
USPC ..... 165/11.1, 200, 297, 104.33, 4, 45; 236/44 B, 91 F; 417/68
See application file for complete search history.

(56) References Cited

U.S. PATENT DOCUMENTS

| | | | | |
|---|---|---|---|---|
| 2,007,406 | A * | 7/1935 | Miller | 165/45 |
| 4,373,573 | A * | 2/1983 | Madwed | 165/45 |
| 4,531,510 | A * | 7/1985 | Barthez et al. | 165/104.33 |
| 5,367,601 | A * | 11/1994 | Hannabery | 236/91 F |
| 5,400,608 | A * | 3/1995 | Steed et al. | 236/44 B |
| 6,259,074 | B1 * | 7/2001 | Brunner et al. | 219/494 |
| 6,264,680 | B1 * | 7/2001 | Ash | 604/6.13 |
| 6,293,241 | B1 * | 9/2001 | Suzuki | 123/142.5 R |
| 6,383,672 | B1 * | 5/2002 | Fujita | 165/297 |
| RE39,288 | E * | 9/2006 | Assaf | 62/94 |
| 7,175,013 | B2 * | 2/2007 | Burns et al. | 192/70.12 |
| 7,531,256 | B2 * | 5/2009 | Hibbs et al. | 429/418 |
| 7,681,404 | B2 * | 3/2010 | Bean, Jr. | 361/699 |
| 7,895,850 | B2 * | 3/2011 | Kitsch | 62/150 |
| 7,908,844 | B2 * | 3/2011 | Kamoshita et al. | 60/286 |
| 7,980,753 | B2 * | 7/2011 | Urquhart et al. | 417/68 |
| 8,448,876 | B2 * | 5/2013 | Yang | 165/45 |
| 8,602,087 | B2 * | 12/2013 | Yang | 165/11.1 |
| 8,607,854 | B2 * | 12/2013 | Yang | 165/200 |
| 8,622,116 | B2 * | 1/2014 | Yang | 165/104.33 |
| 8,651,171 | B2 * | 2/2014 | Yang | 165/200 |
| 8,726,979 | B2 * | 5/2014 | Yang | 165/200 |
| 8,757,504 | B2 * | 6/2014 | Yang | 165/45 |
| 2002/0040775 | A1 * | 4/2002 | Bassilakis | 165/4 |
| 2004/0000159 | A1 * | 1/2004 | Xu | 165/45 |
| 2004/0194909 | A1 * | 10/2004 | Yang | 165/11.1 |
| 2014/0202655 | A1 * | 7/2014 | Yang | 165/45 |

* cited by examiner

*Primary Examiner* — Ljiljana Ciric

(74) *Attorney, Agent, or Firm* — Bacon & Thomas, PLLC

(57) ABSTRACT

A bidirectional pumping device or two unidirectional pumping devices arranged to pump in opposite directions are connected in series with a conventional cold heat-absorbing or warm heat-dissipating energy discharge device, in order to carry out periodic positive and reverse directional pumping. By changing the flow direction of the fluid passing through the flow circuit, temperature differences and impurity accumulation in the heat absorbing/release device are reduced.

26 Claims, 7 Drawing Sheets

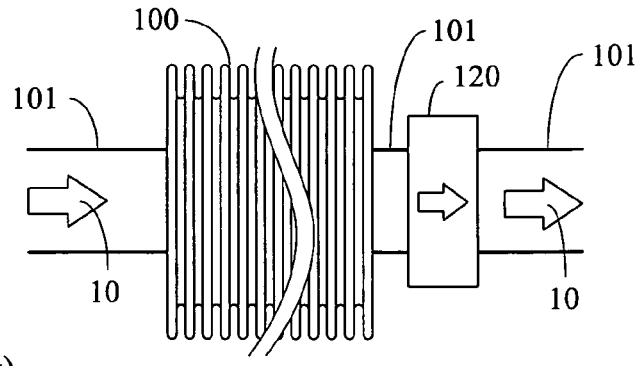
FIG. 1 (Prior Art)
FIG. 2
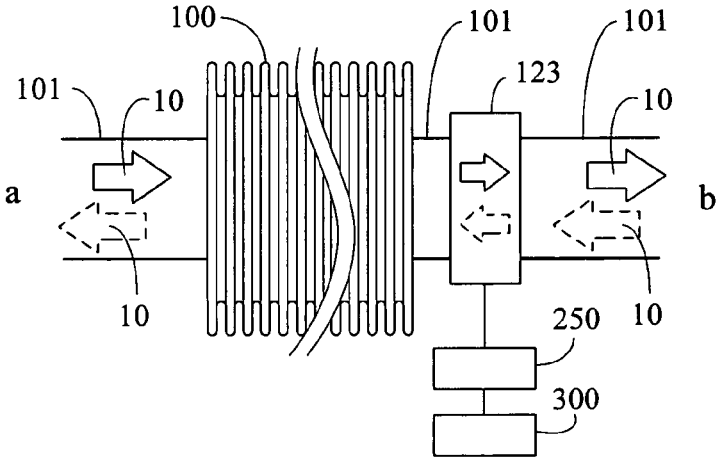
FIG. 3
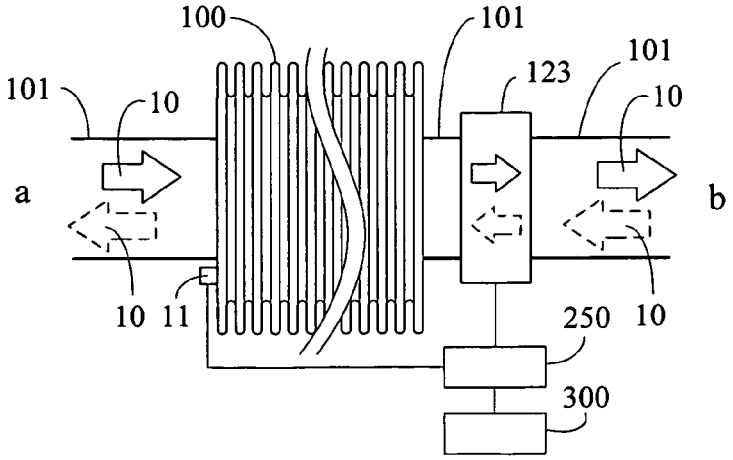

SINGLE FLOW CIRCUIT HEAT ABSORBING/RELEASE DEVICE FOR PERIODIC POSITIVE AND REVERSE DIRECTIONAL PUMPING

BACKGROUND OF THE INVENTION (a) Field of the Invention

The present invention is an improvement over conventional heat-absorbing energy discharge devices for cooling applications and heat-dissipating energy discharge devices for warming applications. The improvement is to vary the fixed flow direction of the single direction circuit to include periodic positive and reverse directional pumping, thereby improving the temperature distribution between a fluid and a heat absorbing/release device, and reducing the disadvantage of impurity or pollutant accumulation in a fixed flow direction.

(b) Description of the Prior Art

FIG. 1 is a schematic view showing the main structure of a conventional single-direction fluid flow circuit with a pumping device having a fixed flow direction and a heat-absorbing energy discharge device for cooling applications or a heat-dissipating energy discharge device for warming applications. As shown in FIG. 1, the fluid (10) is pumped into the fluid port at a side with a first temperature and discharged out of the fluid port at another side with a different temperature as it is pumped through the flow circuit (101) by a fluid pumping device (120) in a fixed flow direction. Because the fluid flow direction of the fluid (10) passing through the flow circuit (101) is fixed, the temperature difference gradient inside the heat-absorbing or heat-dissipating energy discharge device (100) is unchanged.

SUMMARY OF THE INVENTION

The present invention modifies the conventional heat-absorbing or heat-dissipating energy discharge device (100), in which pumping fluid (10) passes through the flow circuit (101) in a fixed flow direction, by series connecting the energy discharge device (100) with a bidirectional fluid pumping device driven by a power source (300) and operatively controlled by a periodic fluid direction-change operative control device (250) for periodic positive and reverse directional pumping. The periodic fluid direction change has the following effects: 1) by causing the fluid (10) to pass through the flow circuit (101) in different flow directions in heat exchange applications, the internal temperature difference distribution status of the energy discharge device controlled to promote heat exchange efficiency; 2) the impurities or pollutants brought in by the fluid (10) passing through the flow circuit (101) in a previous flow direction are discharged by the periodic positive and reverse directional pumping, thereby reducing the disadvantage of impurity or pollutant accumulation that occurs in times of fixed flow direction.

BRIEF DESCRIPTION OF THE DRAWINGS

FIG. 1 is a schematic view of a conventional single flow circuit including fluid pumping device having a fixed flow direction.

FIG. 2 is a schematic view single-flow circuit with a heat absorbing/release device driven by a bidirectional fluid pumping device according to the present invention.

FIG. 3 is a schematic view of a single flow circuit with a heat absorbing/release device according to the present invention, and arranged for periodic positive and reverse directional pumping driven by a bidirectional fluid pumping device and installed with a temperature detecting device at one side thereof.

DETAILED DESCRIPTION OF THE PREFERRED EMBODIMENTS

Figure 4:
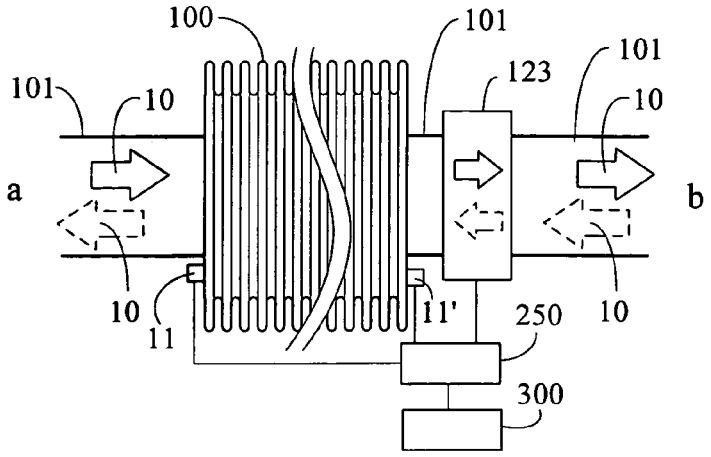
FIG. 4 is a schematic view of a single flow circuit with the heat absorbing/release device of the present invention, arranged for periodic positive and reverse directional pumping driven by a bidirectional fluid pumping device and installed with temperature detecting device at both sides thereof.

FIG. 2 is a schematic view showing a single flow circuit with a heat absorbing/release device driven by a bidirectional fluid pumping device in accordance with the principles of the invention.

As shown in FIG. 2, to achieve periodic positive and reverse directional pumping, a heat-absorbing energy discharge device (100) for cooling applications or a heat-dissipating energy discharge device (100) for warming applications is series connected with the bidirectional fluid pumping device (123) for periodic positive and reverse directional pumping. The pumping device (123) is driven by the power source (300) and operatively controlled by a periodic fluid direction-change operative control device (250) so as to cause the fluid (10) passing through the flow circuit (101) to periodically change flow direction. More specifically:

The bidirectional fluid pumping device (123) is constituted by 1) a fluid pumping device capable of producing a positive pressure to push fluid; or 2) a fluid pumping device capable of producing negative pressure to attract fluid; or 3) a fluid pumping device capable of producing positive pressure to push fluid or of producing negative pressure to attract fluid for pumping gaseous or liquid state fluids (10). The fluid pump is driven by an electric motor supplied with electric power from power source (300), by electric power converted from mechanical energy such as engine power, or by mechanical or electric power converted from other power sources such as wind power, thermal energy, temperature-difference energy, solar energy, etc.

Power source (300) may include an AC or DC city power system or devices of independent power producers.

The periodic fluid direction-change operative control device (250) is constituted by electromechanical components, solid state electronic components, or microprocessors with relevant software and operative control interfaces to operatively control the bidirectional fluid pumping device (123) to have following one or more of the following functions: 1) periodically changing the flow direction of the fluid passing through the heat-absorbing or heat-dissipating energy discharge device (100), thereby operatively controlling the temperature difference distribution status between the fluid (10) passing through the flow circuit (101) and the heat exchanger inside the heat-absorbing or heat-dissipating energy discharge device (100); 2) operatively controlling the flow rate of fluid pumped by the bidirectional fluid pumping device (123) to modulate the temperature of the heat exchanger; and 3) mixed operative control of aforementioned functions 1) and 2).

The timing of the periodic fluid flow direction change can be operatively controlled as follows: 1) the fluid pumping direction may be operatively controlled manually; or 2) the pumping direction of the bidirectional fluid pumping device (123) may be operatively controlled by setting a time period for direction change and using the periodic fluid direction-change operative control device (250) to change the flow direction of the fluid (10) passing through the flow circuit (101).

For example, the energy discharge device shown in FIG. 2 may be a heat-dissipating device for heat release to indoors in cold winter times, in which case relatively high temperature fluid is pumped through the heat-dissipating energy discharging device (100) via the fluid port (a) and is discharged to outdoors via the fluid port (b) by the bidirectional fluid pumping device (123). As a result, the heat-dissipating energy discharging device (100) gradually acquires a temperature distribution from high temperature at the fluid port (a) to a lower temperature at the fluid port (b). This temperature distribution can be reduced by periodically reversing the flow direction by: 1) manually controlling the pumping direction of the bidirectional fluid pumping device (123), or 2) operatively controlling the pumping direction of the bidirectional fluid pumping device (123) by setting a time period for direction change using the periodic fluid direction-change operative control device (250). During reverse direction flow, the fluid is pumped through the heat-dissipating energy discharging device (100) via the fluid port (b) and is discharged via the fluid port (a), so that the energy discharging device (100) is gradually eliminates the temperature distribution from a lower temperature at the fluid port (b) to a higher temperature at the fluid port (a).

FIG. 3 is a schematic view showing a single flow circuit with a heat absorbing/release device, and a bidirectional fluid pumping device and temperature detecting device installed at one side of the heat/absorbing/release device.

As shown in FIG. 3, the at least one temperature detecting device (11) is installed at a position capable of directly or indirectly detecting temperature variation of a fluid and transmitting detected temperature signals back to the periodic fluid direction-change operative control device (250).

The periodic fluid direction-change operative control device (250) is constituted by electromechanical components, solid state electronic components, or microprocessors with relevant software and operative control interfaces to operatively control the bidirectional fluid pumping device (123) to have one or more of the following functions: 1) periodically changing the flow direction of the fluid passing through the heat-absorbing or heat-dissipating energy discharge device (100), thereby operatively controlling the temperature difference distribution status between the fluid (10) passing through the flow circuit (101) and the heat exchanger inside the heat-absorbing or the heat-dissipating energy discharging device (100); or 2) operatively controlling the flow rate of fluid pumped by the bidirectional fluid pumping device (123) to modulate the temperature of the heat exchanger; or 3) mixed operative control of the aforementioned functions 1) and 2);

The operative control methods for periodic fluid direction-change operative control device (250) may include one or more of the following: 1) the pumping direction of the bidirectional fluid pumping device (123) may be manually controlled, or 2) the pumping direction of the bidirectional fluid pumping device (123) may be operatively controlled by setting a predetermined time period, or by setting a time period that depends on temperature variations, using the periodic fluid direction-change operative control device (250), or 3) at least one temperature detecting device (11) being installed at a position capable of directly or indirectly detecting temperature variation of a fluid, detecting signals from the temperature detecting device (11) may be transmitted to the periodic fluid direction-change operative control device (250), so that when the heat dissipating warming energy discharging device (100) reaches a set temperature, the pumping direction of the bidirectional fluid pumping device (123) is operatively controlled to pump the fluid in a reverse flow direction, thereby allowing the fluid (10) to pass through the flow circuit (101) in periodic positive and reverse directions so that the temperature distribution status of the heat dissipating warming energy discharging device (100) is changed accordingly.

In the example of FIG. 3, the heat-dissipating energy discharge device may be used for indoor heat release in cold winter times, in which case the higher indoor temperature fluid flow is pumped by the bidirectional fluid pumping device (123) through the heat-dissipating energy discharge device (100) via the fluid port (a) and is discharged to outdoors via the fluid port (b), the heat-dissipating energy discharging device (100) gradually developing a temperature distribution from high temperature at fluid port (a) to the lower temperature at fluid port (b). The temperature distribution is, however, reduced by 1) manually changing the pumping direction of the bidirectional fluid pumping device (123), or 2) using at least one temperature detecting device (11) installed at a position capable of directly or indirectly detecting temperature variation of fluid to detect the temperature and transmit a temperature signal to the periodic fluid direction-change operative control device (250) to operatively control the pumping direction of the bidirectional fluid pumping device (123), or 3) operatively controlling the pumping direction of the bidirectional fluid pumping device (123) by setting a direction-change time period for changing the fluid flow direction using the periodic fluid direction-change operative control device (250), so that the higher temperature fluid flow is pumped through the heat dissipating warming energy discharging device (100) via the fluid port (b) and is discharged via the fluid port (a), the heat-dissipating energy discharging device (100) thereby reversing the temperature distribution to lower the temperature at the fluid port (b) and increase the temperature at the fluid port (a), so that the temperature distribution status of the heat dissipating warming energy discharging device (100) is changed according to the periodic positive and reverse directional flow pumping the fluid (10) passing through the flow circuit (101).

The temperature detecting devices (11), (11') can be installed at positions near the fluid port (a) and the fluid port (b) on the heat-dissipating warming energy discharging device (100), as shown in FIG. 4. The detected temperature signals are transmitted back to the periodic fluid direction-change operative control device (250) to cause the periodic fluid direction-change operative control device (250) to operatively control the pumping direction of the bidirectional fluid pumping device (123), or the pumping direction of the bidirectional fluid pumping device (123) is operatively controlled by setting a direction-change time period on the periodic fluid direction-change operative control device (250), thereby changing the fluid flow direction so that the higher temperature fluid flow is pumped through the heat-dissipating energy discharging device (100) via the fluid port (b) and is discharged via the fluid port (a), thus gradually forming a temperature distribution having a lowered temperature at the fluid port (b) and an increased temperature at the fluid port (a).

The single flow circuit with a heat absorbing/release device for periodic positive and reverse directional pumping according to the present invention further can optionally use two series unidirectional fluid pumps having different pumping directions to provide the function of the bidirectional fluid pumping device (123).

Figure 5:
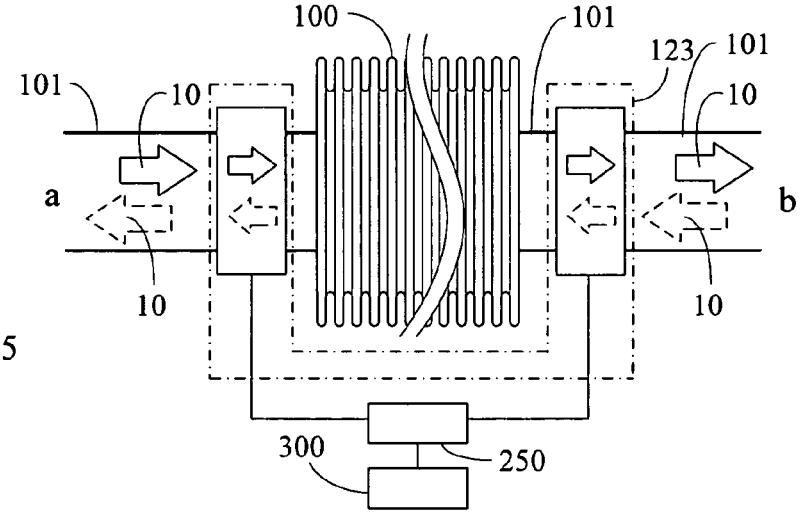
FIG. 5 is a schematic view of a single flow circuit with the heat absorbing/release device of the present invention, in which the bidirectional fluid pumping device is constituted by two unidirectional fluid pumps having different flow pumping directions.

FIG. 5 is a block schematic view showing a single flow circuit with a heat absorbing/release device and a bidirectional fluid pumping device constituted by two unidirectional fluid pumps with different flow pumping directions. As shown in FIG. 5, the pumping direction of the bidirectional fluid pumping device (123) constituted by two unidirectional fluid pumps in different flow directions may be manually operatively controlled, or the pumping direction of the bidirectional fluid pumping device (123) may be operatively controlled by setting a direction-change time period for changing the fluid flow direction on the periodic fluid direction-change operative control device (250), such that the higher temperature fluid flow is pumped through the heat-dissipating energy discharging device (100) via the fluid port (b) and is discharged via the fluid port (a), to gradually form a temperature distribution with a lowered temperature at the fluid port (b) and an increased temperature at the fluid port (a), so that the temperature distribution status of the heat-dissipating energy discharging device (100) is changed according to the periodic positive and reverse directional flow of the fluid (10) passing through the flow circuit (101).

Figure 6:
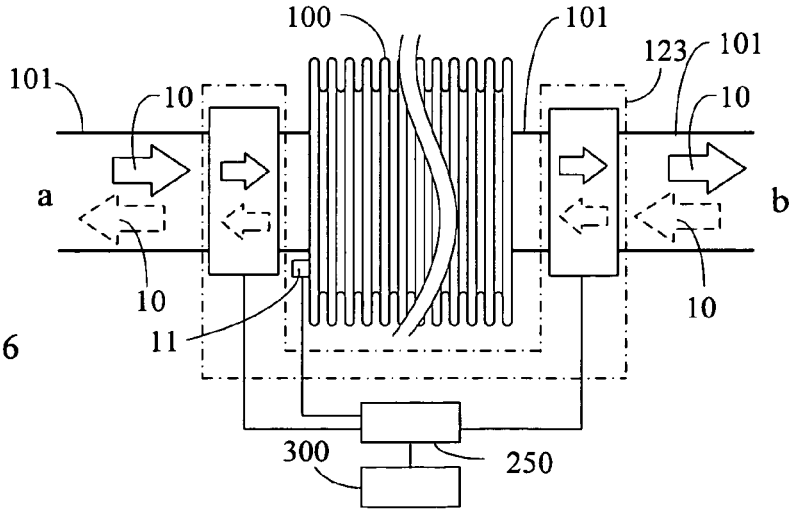
FIG. 6 is a schematic view of the single flow circuit of the present invention, in which the bidirectional fluid pumping device is constituted by two unidirectional fluid pumps having different flow pumping directions and installed with a temperature detecting device at one side thereof.

FIG. 6 is a schematic view showing a single flow circuit with a heat absorbing/release device according to the present invention, for periodic positive and reverse directional pumping a bidirectional fluid pumping device constituted by two unidirectional fluid pumps having different flow pumping directions and installed with a temperature detecting device at one side thereof.

As shown in FIG. 6, the at least one temperature detecting device (11) is installed at a position capable of directly or indirectly detecting temperature variation of the fluid as in the embodiment of FIG. 5, and transmits a detected temperature signal back to the periodic fluid direction-change operative control device (250). A number of methods may be used for operatively controlling the periodic fluid direction-change operative control device (250), including the following: 1) the pumping direction of the bidirectional fluid pumping device (123) may be controlled manually, or 2) the pumping direction of the bidirectional fluid pumping device (123) may be operatively controlled by setting a time period, or by setting a time period that depends on temperature variations, using the periodic fluid direction-change operative control device (250), or 3) causing at least one temperature detecting device (11) installed at a position capable of directly or indirectly detecting the temperature variation of fluid to transmit a detecting signal to the periodic fluid direction-change operative control device (250), so that when the heat-dissipating energy discharging device (100) reaches a set temperature, the pumping direction of the bidirectional fluid pumping device (123) is operatively controlled to pump the fluid in a reverse flow direction and thereby change the temperature distribution status of the heat-dissipating energy discharging device (100).

Figure 7:
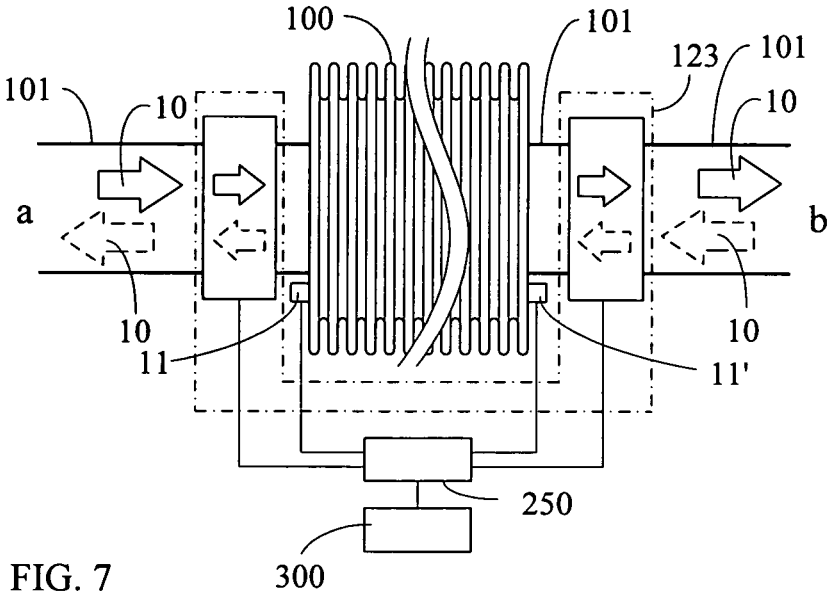
FIG. 7 is a schematic view of the single flow circuit of the present invention in which the bidirectional fluid pumping device is constituted by two unidirectional fluid pumps having different flow pumping directions and installed with temperature detecting devices at both side thereof.

FIG. 7 is a schematic view showing a single flow circuit with a heat absorbing/release device and periodic positive and reverse directional pumping driven by a bidirectional fluid pumping device constituted by two unidirectional fluid pumps having different pumping directions and installed with temperature detecting devices at both sides of the heat absorbing/release device. As shown in FIG. 7, the temperature detecting devices (11), (11') are installed at positions near to the fluid port (a) and the fluid port (b) on the heat-dissipating energy discharging device (100) for transmitting temperature signals back to the periodic fluid direction-change operative control device (250), so as to directly operatively control the pumping direction of the bidirectional fluid pumping device (123), or so as to control the pumping direction of the bidirectional fluid pumping device (123) by setting a direction-change time period. Upon changing the fluid flow direction, the higher temperature fluid flow is pumped through the heat-dissipating energy discharging device (100) via the fluid port (b) and is discharged via the fluid port (a), so that the heat-dissipating energy discharge device (100) gradually acquires a temperature distribution with a lowered temperature at the fluid port (b) and an increased temperature at the fluid port (a).

Figure 8:
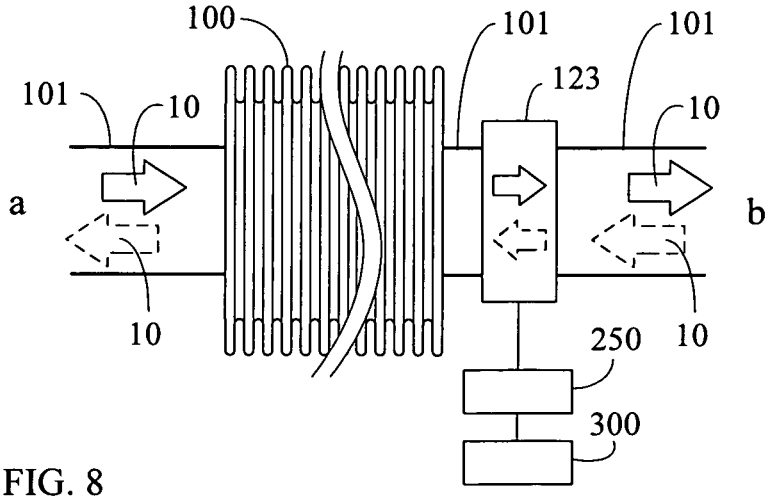
FIG. 8 is a schematic view of an embodiment of the present invention in which at least one fluid pump capable of bidirectionally pumping the fluid is installed at a position on either the fluid port (a) or the fluid port (b) of a heat-absorbing energy discharge device for cooling applications or a heat-dissipating energy discharge device for warming applications.
Figure 9:
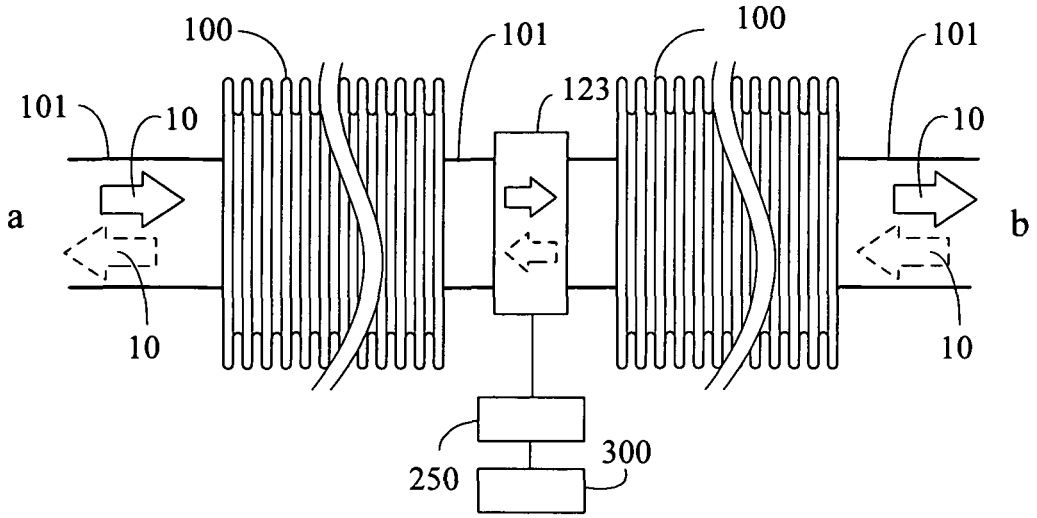
FIG. 9 is a schematic view of an embodiment of the present invention in which at least one fluid pump capable of bidirectionally pumping the fluid is installed in the middle of the heat-absorbing energy-discharge cooling device or the heat-dissipating energy-discharge warming device.
Figure 10:
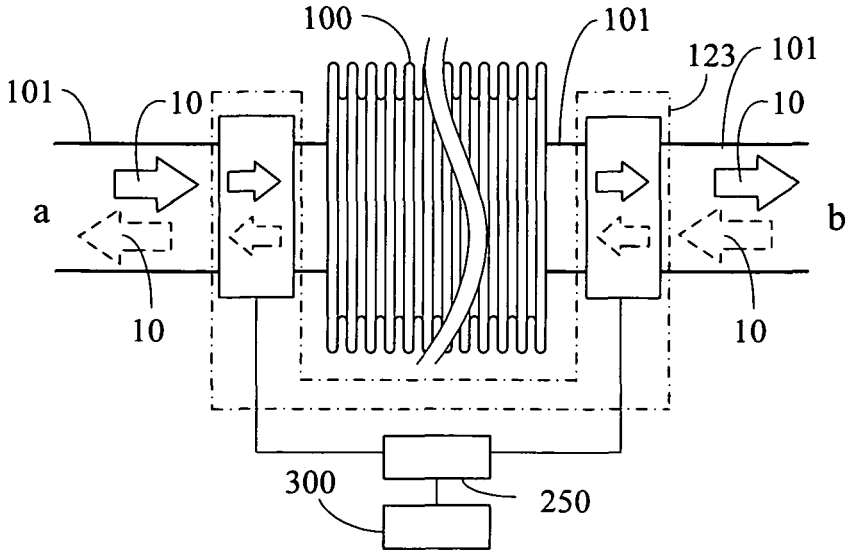
FIG. 10 is a schematic view of an embodiment of the present invention in which at least two fluid pumps capable of bidirectionally pumping the fluid are respectively installed on the fluid port (a) and the fluid port (b) at two ends of the heat-absorbing energy-discharge cooling device or the heat-dissipating energy-discharge warming device.
Figure 11:
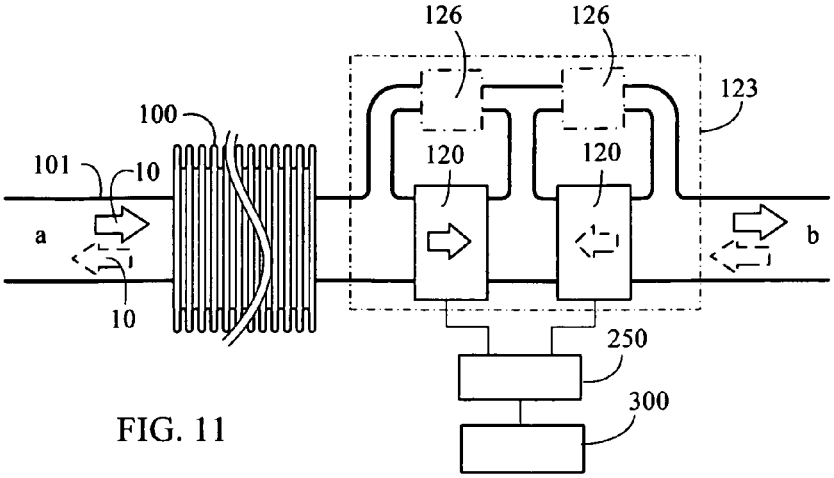
FIG. 11 is a schematic view of an embodiment of the present invention in which at least two unidirectional fluid pumps having different pumping directions are series connected to constitute a bidirectional fluid pumping device and installed at a position on either one of the fluid port (a) or the fluid port (b) of the heat-absorbing energy discharge device or the heat-dissipating energy discharge device.
Figure 12:
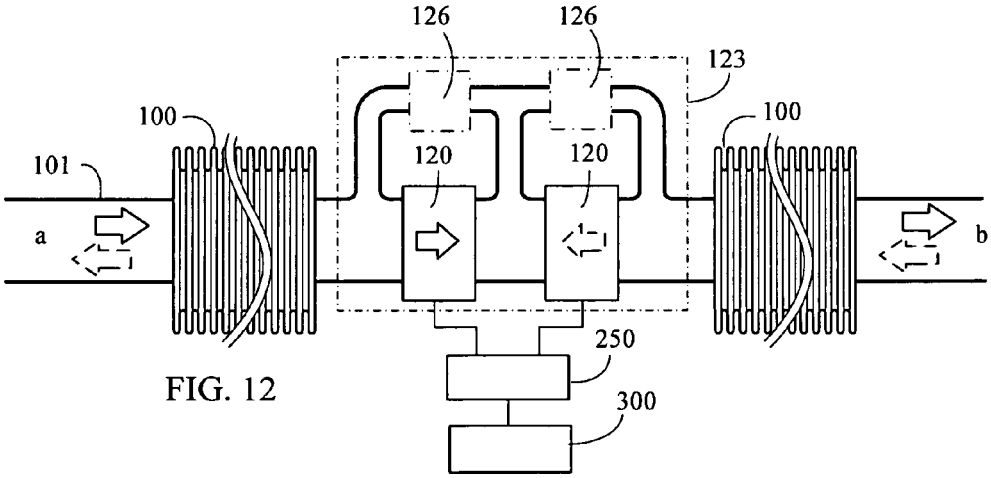
FIG. 12 is a schematic view of an embodiment of the present invention showing in which at least two unidirectional fluid pumps having different pumping directions are series connected to constitute a bidirectional fluid pumping device and installed at the middle section of the heat-absorbing energy discharge device or the heat-dissipating energy discharge device.
Figure 13:
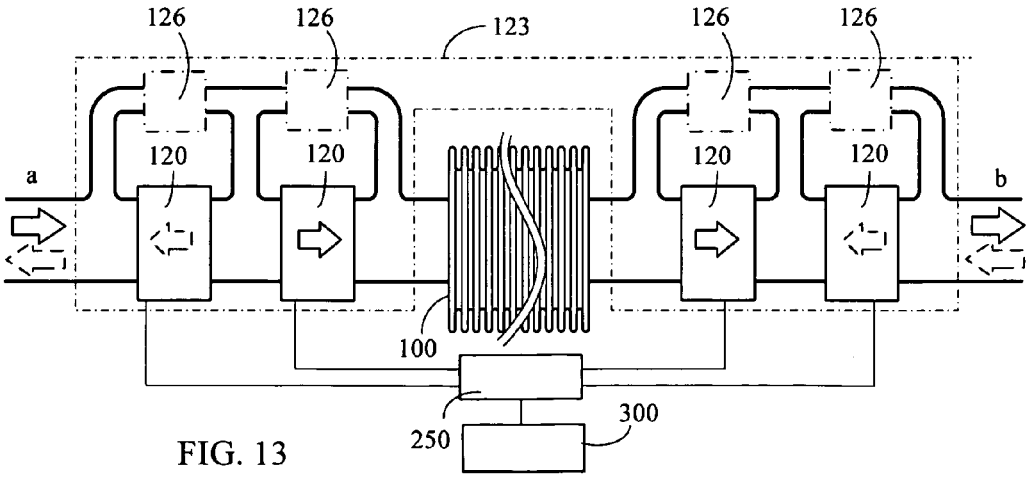
FIG. 13 is a schematic view of an embodiment of the present invention in which at least two unidirectional fluid pumps having different pumping directions are series connected to constitute a bidirectional fluid pumping device and installed on the fluid port (a) and the fluid port (b) at the two ends of the heat-absorbing energy discharge device or the heat-dissipating energy discharge device.
Figure 14:
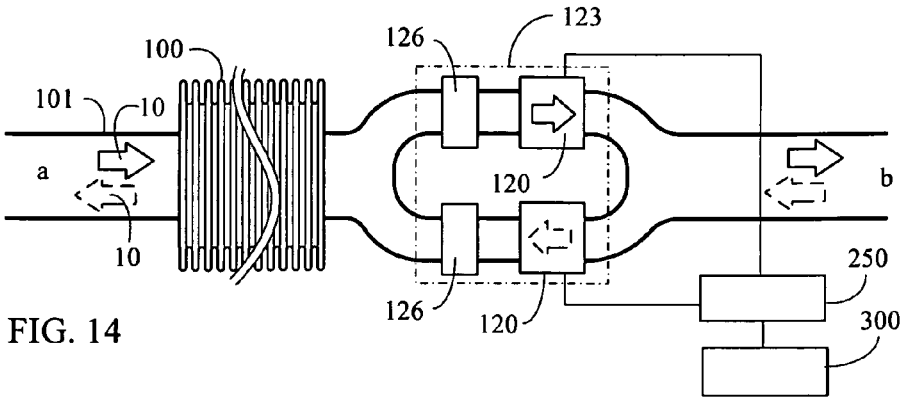
FIG. 14 is a schematic view of an embodiment of the present invention in which at least two unidirectional fluid pumps having different pumping directions are parallel connected to constitute a bidirectional fluid pumping device and installed at a position on either one of the fluid port (a) and the fluid port (b) of the heat-absorbing or the heat-dissipating energy discharge device.

Still further, the fluid pumping device(s) (123) of the single flow circuit with heat absorbing/release device may be configured as follows:

1. The pumping device(s) (123) may include at least one fluid pump capable of bidirectionally pumping the fluid and installed at a position on either the fluid port (a) or the fluid port (b) of the heat-absorbing or heat-dissipating energy discharging device (100) and a control device (250) to operatively control the bidirectional fluid pump to periodically pump in positive or reverse directions, thereby periodically changing the fluid direction. As shown in FIG. 8, the at least one fluid pump capable of bidirectionally pumping the fluid is installed at a position on either fluid port (a) or fluid port (b) of the heat-absorbing or heat-dissipating energy discharge device.
2. The pumping device(s) (123) may alternatively include at least one fluid pump capable of bidirectionally pumping the fluid and installed in the middle of the heat-absorbing or heat-dissipating energy discharging device (100) to operatively control the bidirectional fluid pump to periodic pump in positive or reverse directions under control of the periodic fluid direction-change operative control device (250), thereby periodically changing the fluid direction as shown in FIG. 9.
3. The pumping device(s) (123) may also include at least two fluid pumps capable of bidirectionally pumping the fluid and respectively installed on the fluid port (a) and the fluid port (b) at two ends of the heat-absorbing or heat-dissipating warming energy discharging device (100), using the periodic fluid direction-change operative control device (250) to operatively control the bidirectional fluid pump to allow the single flow circuit to have one or more than one operational functions as follows: 1) the respective pumping devices (123) simultaneously pump in the same direction as well as, periodically, simultaneously changing the pumping direction, or 2) one of the fluid pumps capable of bidirectionally pumping the fluid may be respectively installed on the fluid port (a) and another on the fluid port (b) to alternately pump in different directions, as shown in FIG. 10.
4. The pump device(s) (123) may include at least two unidirectional fluid pumps having different pumping directions and connected in series to constitute the bidirectional fluid pumping device installed either one of the fluid port (a) or the fluid port (b) of the heat-absorbing or the heat-dissipating energy discharging device (100), to thereby periodically change the fluid direction. If the unidirectional fluid pumps constituting the bidirectional fluid pumping device (123) are irreversible, the individual unidirectional fluid pumps can be respectively parallel connected by a reversible unidirectional valve (126), as shown in FIG. 11.
5. The pumping device(s) may include at least two unidirectional fluid pumps having different pumping directions in series connection and installed at the middle section of the heat-absorbing or the heat-dissipating energy discharging device (100) to operatively control the periodic fluid direction-change operative control device (250) and alternately use one of the unidirectional fluid pumps to pump periodically in one direction, thereby periodically changing the fluid direction. If the unidirectional fluid pump constituting the bidirectional fluid pump device (123) is irreversible, the individual unidirectional fluid pumps can respectively be paralleled connect with a reversible unidirectional valve (126), as shown in FIG. 12.
6. The pumping device(s) (123) may also include at least two unidirectional fluid pumps having different pumping directions in series connection to constitute a bidirectional fluid pumping device respectively installed on the fluid port (a) and the fluid port (b) at the two ends of the heat-absorbing or heat-dissipating energy discharging device (100), using the periodic fluid direction-change operative control device (250) to operatively control the unidirectional fluid pumps and provide periodic positive and reverse directional pumping as follows: 1) the two unidirectional fluid pumps may be controlled for simultaneously pumping in the same direction as well as simultaneously changing the pumping direction periodically, or 2) the unidirectional fluid pumps having different pumping directions may be respectively installed on the fluid port (a) and the fluid port (b) subject to the operative control of the periodic fluid direction-change operative control device (250) to alternately cause one of the unidirectional fluid pumps to pump in one direction and the other to alternately pump in the other direction, thereby periodically changing the fluid direction. If the unidirectional fluid pump constituting the bidirectional fluid pump device (123) is irreversible, the individual unidirectional fluid pump can be respectively parallel connected with a reversible unidirectional valve (126), as shown in FIG. 13.
7. The pumping device(s) (123) may further include at least two unidirectional fluid pumps having different pumping directions in parallel connection and installed at a position on either one of the fluid port (a) and the fluid port (b) of the heat-absorbing or the heat-dissipating energy discharging device (100). By operative control of the periodic fluid direction-change operative control device (250), the unidirectional fluid pumps can be caused to pump alternately, thereby periodically changing the fluid direction. If the unidirectional fluid pumps do not have an anti-reverse flow function, the individual fluid pumps can also be respectively series connected with a unidirectional valve (126) with a forward polarity before being parallel connected to avoid reverse flows, as shown in FIG. 14.

Figure 15:
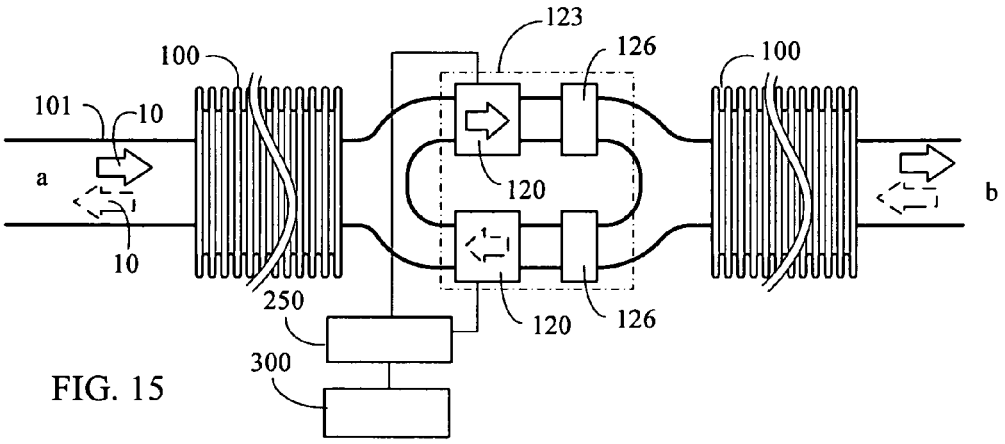
FIG. 15 is a schematic view of an embodiment of the present invention in which at least two unidirectional fluid pumps having different pumping directions are parallel connected to constitute a bidirectional fluid pumping device and installed at the middle section of the heat exchanger.
Figure 16:
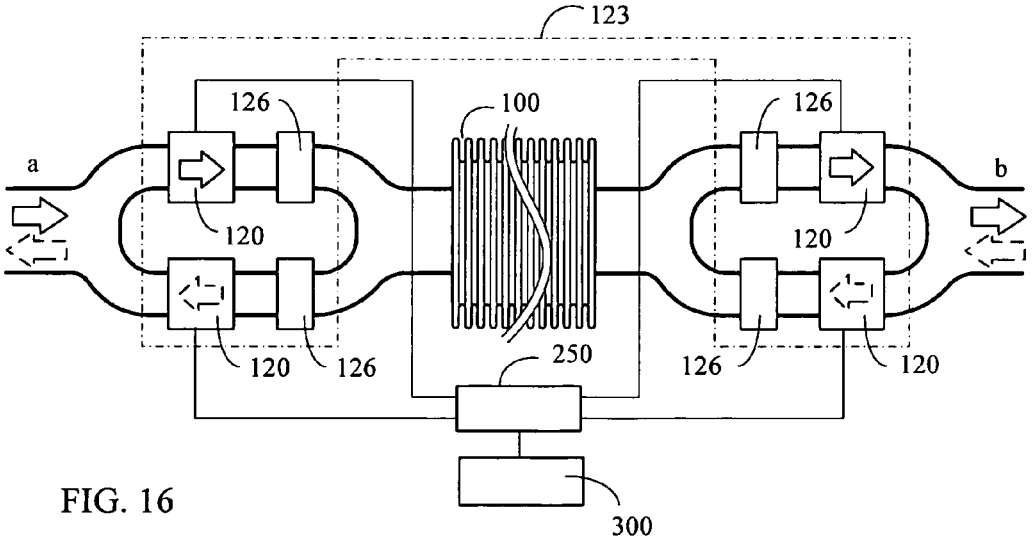
FIG. 16 is a schematic view of an embodiment of the present invention in which at least two unidirectional fluid pumps having different pumping directions are parallel connected to constitute a bidirectional fluid pumping device and installed on the fluid port (a) and the fluid port (b) at the two ends of the heat-absorbing or the heat-dissipating energy discharge device.
Figure 17:
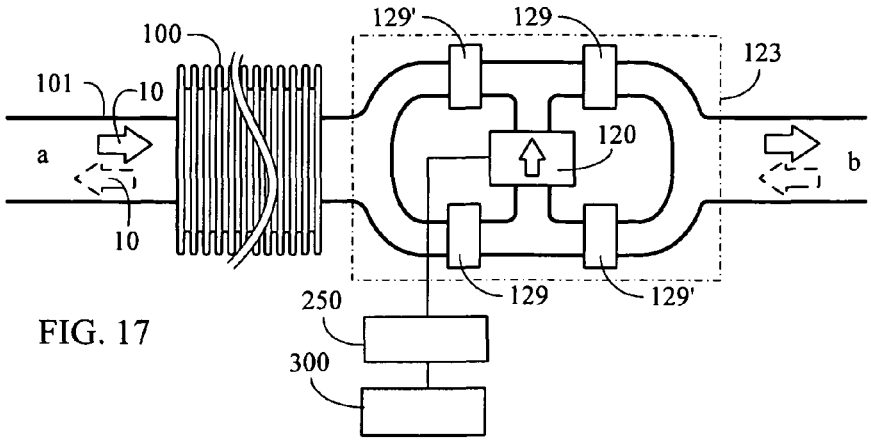
FIG. 17 is a schematic view of an embodiment of the present invention constituted by at least one unidirectional fluid pump and four controllable switch type fluid valves in a bridge type arrangement on either one of the fluid port (a) or the fluid port (b) at one end of the heat-absorbing or heat-dissipating energy discharge device.
Figure 18:
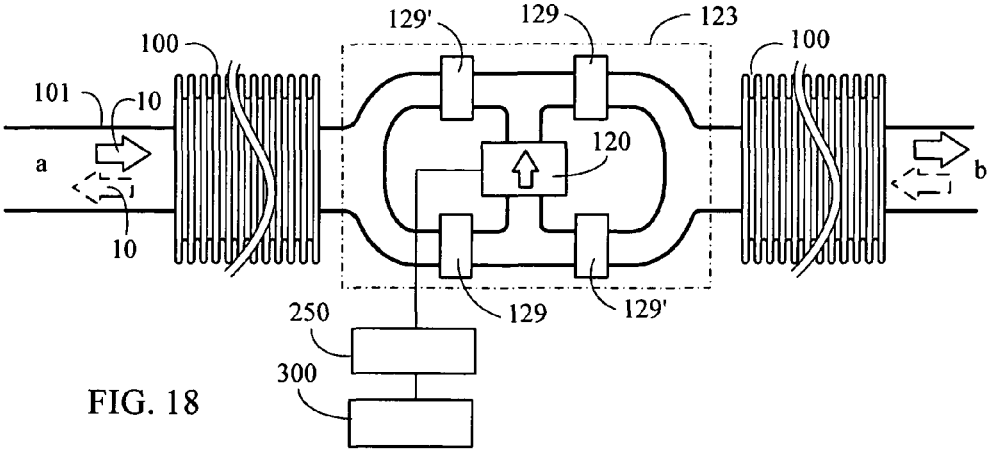
FIG. 18 is a schematic view of an embodiment of the present invention constituted by at least one unidirectional fluid pump and four controllable switch type fluid valves in a bridge type arrangement installed at a middle section of the heat-absorbing or heat-dissipating energy discharge device.
Figure 19:
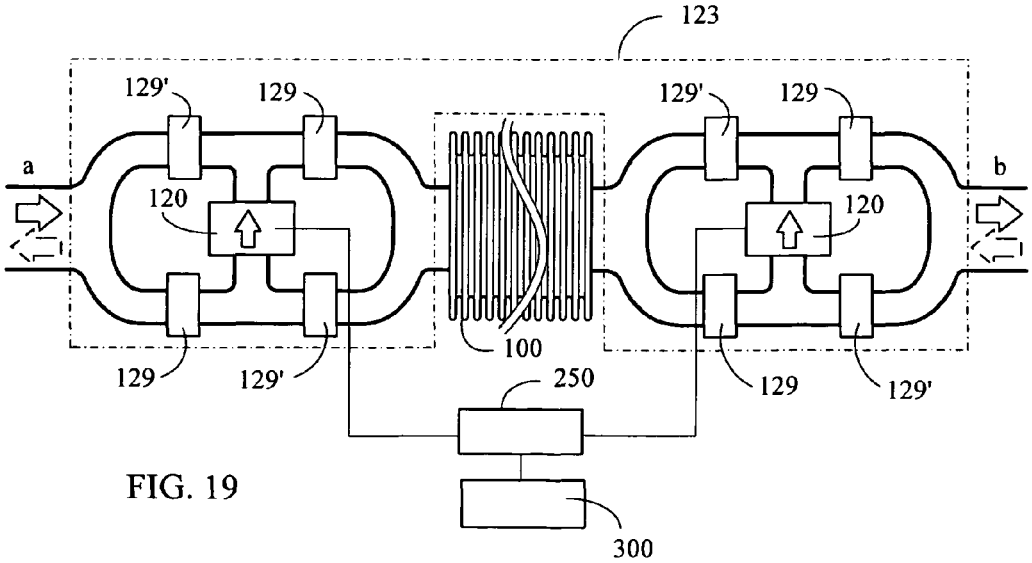
FIG. 19 is a schematic view of an embodiment of the present invention constituted by at least two unidirectional fluid pumps and four controllable switch type fluid valves in a bridge type arrangement installed on the fluid port (a) and the fluid port (b) at the two ends of the heat-absorbing or the heat-dissipating energy discharge device.

8. The pumping device(s) may include at least two unidirectional fluid pumps having different pumping directions in parallel connection to constitute bidirectional fluid pumping device installed at the middle section of the heat-absorbing or heat-dissipating energy discharging device (100). The periodic fluid direction-change operative control device (250) is used to periodically operatively control one of the unidirectional fluid pumps to pump alternately, thereby periodically changing the fluid direction. If the structure of the unidirectional fluid pump used by the bidirectional fluid pumping device (123) does not have an anti-reverse flow function, the individual fluid pump can first be respectively series connected with a unidirectional valve (126) having a forward polarity before being parallel connected to avoid reverse flow, as shown in FIG. 15.
9. The pumping device(s) (123) may also include at least two unidirectional fluid pumps having different pumping directions in parallel connection and installed on the fluid port (a) and the fluid port (b) at the two ends of the heat-absorbing or heat-dissipating energy discharging device (100). By means of the periodic fluid direction-change operative control device (250), the unidirectional fluid pumps may be operatively controlled to have one or more than one of the following operational functions, as follows: 1) simultaneous pumping in the same direction as well as simultaneous changing of the pumping direction periodically, or 2) the unidirectional fluid pumps respectively installed on the fluid port (a) and the fluid port (b) may be operatively controlled by the periodic fluid direction-change operative control device (250) to alternately pump in their respective opposite directions, thereby periodically changing the fluid direction. If one or both of the unidirectional fluid pumps is irreversible, the respective individual unidirectional fluid pump can be parallel connected with a reversible unidirectional valve (126), as shown in FIG. 16.
10. The pumping device(s) (123) may be constituted by at least one unidirectional fluid pump and four controllable switch type fluid valves (129, 129') in a bridge type combination, and installed at a position on either one of the fluid port (a) or the fluid port (b) of the heat-absorbing or heat-dissipating energy discharging device (100) to alternately control the two fluid valves (129) to open and the other two fluid valves (129') to close, or the two fluid valves (120) to close and the other two fluid valves (129') to open, by the periodic fluid direction-change operative control device (250) during the operation of the unidirectional fluid pump, thereby periodically changing the fluid direction, as shown in FIG. 17.
11. The pumping devices may be constituted by at least one unidirectional fluid pump and four controllable switch type fluid valves (129, 129') in bridge type combination, and installed at a middle section of the heat-absorbing or heat-dissipating energy discharging device (100), to thereby alternately control two of the fluid valves (129) to open and the other two fluid valves (129') to close, or two fluid valves (120) to close and the other two fluid valves (129') to open, using the periodic fluid direction-change operative control device (250) during the operation of the unidirectional fluid pump to thereby periodically change the fluid direction, as shown in FIG. 18.
12. Finally, the pumping device(s) (123) may be constituted by at least two unidirectional fluid pumps and four controllable switch type fluid valves (129, 129') in bridge type combination, and installed on the fluid port (a) and the fluid port (b) at two ends of the heat-absorbing or heat-dissipating energy discharging device (100) to thereby alternately control two of the fluid valves (129) to open and the other two fluid valves (129') to close, or two fluid valves (120) to close and the other two fluid valves (129') to open, using the periodic fluid direction-change operative control device (250) during the operation of the unidirectional fluid pump to thereby periodically change the fluid direction, as shown in FIG. 19.

The heat-absorbing cooling energy discharge device or the heat-dissipating warming energy discharge device (100) of the single flow circuit with heat absorbing/release device for periodic positive and reverse directional pumping according to the present invention may, in different embodiments of the invention, include one or more of the following structural configurations: 1) a tubular structure in linear or other geometric shapes; 2) a multi-layer structure having a fluid path for passing gaseous or liquid state fluids; 3) a plurality of single flow circuit heat absorbing/release devices, in which the flow circuit includes one or more than one circuit in series connection, parallel connection, or series and parallel connection.

The periodic fluid direction-change operative control device (250) of the single flow circuit with heat absorbing/release device of the present invention may be equipped with an electric motor, controllable engine power, or mechanical or electric power generated or converted from other energy sources, such as wind energy, thermal energy, temperature-difference energy, or solar energy for controlling various fluid pumps and driving or controlling the operation timing of the fluid pumps or fluid valves, thereby changing the direction of the fluid passing through the heat-absorbing or heat-dissipating energy discharging device (100), and further operatively control some or all modulation functions including rotational speed, flow rate, and fluid pressure of various fluid pumps.

In the single flow circuit with heat absorbing/release device of the present invention, when a flow direction change is carried out, to mitigate the impact of the sudden change in direction of the gaseous or liquid state fluid in the course of pumping, including the liquid hammer effect generated when pumping of a liquid is interrupted, one or more than one operational methods can be further added to the operational modes of the flow direction change control:

1) The fluid pump or fluid valve may be operatively controlled to slowly reduce the flow rate of the fluid, and then be switched to slowly increase the flow rate of the fluid to a maximum preset value in the other flow direction;
2) The fluid pump or fluid valve may be operatively controlled to slowly reduce the flow rate of fluid, and to be switched to stop pumping for a preset time period, and then further switched to slowly increase the flow rate of the fluid to a maximum preset value in the other flow direction.

The invention claimed is:

1. A single flow circuit, comprising:

an energy discharge device including a heat exchanger for exchange of energy with a fluid in the single flow circuit; and reversible pumping means consisting of a pumping device in series with the energy discharge device for pumping said fluid in a first flow direction through the heat exchanger, and for periodically pumping said fluid in a reverse flow direction opposite the first flow direction to thereby change a temperature difference distribution status of the energy discharge device to enhance heat exchange efficiency and reduce accumulation of impurities or pollutants in the flow circuit as it passes through the heat exchanger of the energy discharge device, and further comprising at least one temperature detecting device arranged to detect a temperature variation of the fluid and to transmit detected temperature signals back to the periodic direction-change control device such that when a temperature of the energy discharging device reaches a preset temperature, the fluid pumping direction is operatively controlled to pump the fluid in reverse flow direction and change the temperature difference distribution status of the energy discharging device.

2. The single flow circuit as recited in claim 1, wherein said pumping device is a bidirectional pumping device in series with the energy discharge device driven by a power source and operatively controlled by a direction-change control device to periodically change direction.

3. The single flow circuit as recited in claim 2, wherein said bidirectional fluid pumping device is one of a (1) fluid pumping device arranged to produce positive pressure to push the fluid; (2) a fluid pumping device arranged to produce negative pressure to attract the fluid; and (3) a fluid pumping device capable of producing positive pressure to push the fluid and negative pressure to attract the fluid, said pumping device being driven by an electric motor supplied with electric power from the power source.

4. The single flow circuit as recited in claim 2, wherein said periodic direction-change control device includes electromechanical components, solid state electrical components, or microprocessors, software and operative control interfaces to operatively control the bidirectional fluid pumping device to have at least one of the following functions: (1) periodically changing the pumping direction of the pumping device to change the flow direction; (2) controlling the flow rate of fluid pumped by the pumping device to modulate a temperature of heat exchanger; and (3) mixed operative control of the pumping device to periodically change the pumping direction and control the flow rate.

5. The single flow circuit as recited in claim 1, wherein said pumping device includes two unidirectional fluid pumps, one of which causes the fluid to flow in the first flow direction and the other of which causes the fluid to flow in the reverse flow direction, said two unidirectional fluid pumps being alternately driven by a direction-change control device to periodically change a fluid pumping direction.

6. The single flow circuit as recited in claim 5, wherein if at least one of the unidirectional pumping devices is irreversible, said single flow circuit further comprises at least one unidirectional valve respectively connected in parallel with the at least one unidirectional pumping device that is irreversible.

7. The single flow circuit as recited in claim 5, wherein the unidirectional pumping devices are installed in series in a middle section of the energy discharging device.

8. The single flow circuit as recited in claim 7, wherein if at least one of the unidirectional pumping devices is irreversible, said single flow circuit further comprises at least one unidirectional valve respectively connected in parallel with the at least one unidirectional pumping device that is irreversible.

9. The single flow circuit as recited in claim 5, wherein the unidirectional pumping devices are installed in parallel in a middle section of the energy discharging device.

10. The single flow circuit as recited in claim 9, wherein if at least one of the unidirectional pumping devices is irreversible, said single flow circuit further comprises at least one unidirectional valve respectively series-connected with the irreversible universal pumping device and connected in parallel with the other unidirectional pumping device.

11. The single flow circuit as recited in claim 5, wherein a pair of the unidirectional pumping devices are installed in series at each end of the energy discharging device.

12. The single flow circuit as recited in claim 11, wherein if at least one of the unidirectional pumping devices is irreversible, said single flow circuit further comprises at least one unidirectional valve respectively connected in parallel with the at least one unidirectional pumping device that is irreversible.

13. The single flow circuit as recited in claim 5, wherein the unidirectional pumping devices are installed in parallel at each end of the energy discharging device.

14. The single flow circuit as recited in claim 13, wherein if at least one of the unidirectional pumping devices is irreversible, said single flow circuit further comprises at least one unidirectional valve respectively series-connected with the irreversible universal pumping device and connected in parallel with the other unidirectional pumping device.

15. The single flow circuit as recited in claim 1, wherein the pumping device comprises at least one unidirectional fluid pump and four controllable switch type fluid valves connected in a bridge arrangement, pairs of said fluid valves being alternately opened and closed to change said fluid flow direction.

16. The single flow circuit as recited in claim 15, wherein said bridge arrangement is located in a middle of said energy discharge device.

17. The single flow circuit as recited in claim 15, wherein one said bridge arrangement is located at each end of the fluid flow path through the energy discharge device.

18. The single flow circuit as recited in claim 1, wherein the energy discharge device has one of a tubular structure and a structure including more than one said heat exchanger.

19. The single flow circuit as recited in claim 1, wherein a direction-change control device controls a direction of fluid flow and, in addition, at least one of a rotational speed, flow rate, and fluid pressure of the pumping device.

20. The single flow circuit as recited in claim 1, wherein a direction-change control device is arranged to decrease or increase the flow rate of the fluid over a predetermined period when changing flow direction in order to mitigate an impact of the direction change on the energy discharge device.

21. A single flow circuit, comprising:

an energy discharge device arranged to absorb or dissipate heat for cooling or heating, said energy discharge device including a heat exchanger for exchange of energy with a fluid in the single flow circuit; and reversible pumping means consisting of a pumping device in series with the energy discharge device for pumping said fluid in a first flow direction through the heat exchanger, and for periodically pumping said fluid in a reverse flow direction opposite the first flow direction to thereby change a temperature difference distribution status of the energy discharge device to enhance heat exchange efficiency and reduce accumulation of impurities or pollutants in the flow circuit as the fluid passes through the heat exchanger of the energy discharge device, wherein the fluid pumping direction is manually controlled through the periodic direction-change control device, or operatively controlled by setting a time period for the direction change, and wherein the fluid passes through the energy discharging device from a first fluid port to a second fluid port, the fluid passing through said first fluid port increasing in temperature and the fluid passing through the second fluid port decreasing in temperature as the fluid is pumped in the first flow direction, and the fluid passing through said first fluid port decreasing in temperature and the fluid passing through the second fluid port increasing in temperature as the fluid is pumped in the second flow direction opposite to the first flow direction.

22. The single flow circuit as recited in claim 21, wherein said pumping device is a bidirectional pumping device in series with the energy discharge device driven by a power source and operatively controlled by a direction-change control device to periodically change direction.

23. A single flow circuit, comprising:

an energy discharge device arranged to absorb or dissipate heat for cooling or heating, said energy discharge device including a heat exchanger for exchange of energy with a fluid;

reversible pumping means including a pumping device in series with the energy discharge device for pumping said fluid in a first flow direction through the heat exchanger, said pumping device periodically pumping said fluid in a reverse flow direction opposite the first flow direction to thereby change a temperature difference distribution status of the energy discharge device to enhance heat exchange efficiency and reduce accumulation of impurities or pollutants in the flow circuit as the fluid passes through the heat exchanger of the energy discharge device, wherein the at least one temperature detecting device includes two temperature detecting devices installed near the respective first fluid port and second fluid port to detect a temperature difference between the first fluid port and the second fluid port and, based on an increasing temperature difference between the higher-temperature first fluid port and the lower-temperature second fluid port, transmit a temperature difference signal to the direction-change control device to cause the pumping device to change the fluid flow direction and lower a temperature of the first fluid port and increase a temperature of the second fluid port.

24. The single flow circuit as recited in claim 23, wherein said pumping device is a bidirectional pumping device in series with the energy discharge device driven by a power source and operatively controlled by a direction-change control device to periodically change direction.

25. The single flow circuit as recited in claim 21, wherein said pumping device includes two unidirectional fluid pumps, one of which causes the fluid to flow in the first flow direction and the other of which causes the fluid to flow in the reverse flow direction, said two unidirectional fluid pumps being alternately driven by a direction-change control device to periodically change a fluid pumping direction.

26. The single flow circuit as recited in claim 23, wherein said pumping device includes two unidirectional fluid pumps, one of which causes the fluid to flow in the first flow direction and the other of which causes the fluid to flow in the reverse flow direction, said two unidirectional fluid pumps being alternately driven by a direction-change control device to periodically change a fluid pumping direction.

* * * * *